United States Patent [19]

Zollinger

[11] 4,005,833

[45] Feb. 1, 1977

[54] YARN TENSIONING DEVICE

[76] Inventor: Otto Zollinger, 120 Pine Acres Drive, Spartanburg, S.C. 29301

[22] Filed: Sept. 11, 1975

[21] Appl. No.: 612,379

[52] U.S. Cl. ..... 242/152.1
[51] Int. Cl.[2] ..... B65H 59/30
[58] Field of Search ..... 242/152.1, 147 R, 149, 242/147

[56] References Cited

FOREIGN PATENTS OR APPLICATIONS

| | | | |
|---|---|---|---|
| 6,576 | 4/1910 | United Kingdom | 242/152.1 |
| 1,965 | 4/1915 | United Kingdom | 242/152.1 |

*Primary Examiner*—Stanley N. Gilreath
*Attorney, Agent, or Firm*—Joseph H. Heard

[57] ABSTRACT

In a tensioning device of the seated-ball type, an annular ball seating member is mounted in vertically adjustable spaced relationship to a tubular ball retaining member disposed thereabove and in axial alignment therewith. A ball element supported upon the seating member projects upwardly therefrom into the tubular member and is thereby restrained against excessive lateral movement during operation of the device, at which time the yarn undergoing tensioning passes upwardly through the seating member and then laterally therefrom through the space between the seating member and the overlying tubular member. The vertical adjustability of the seating member permits various changes to be made in the operating characteristics of the device, including variation of the degree of lateral constraint imposed upon the ball element.

8 Claims, 9 Drawing Figures

YARN TENSIONING DEVICE

BACKGROUND OF THE INVENTION

This invention relates to devices for tensioning running textile yarns, which term is intended to encompass all types of textile strands, filaments and the like; and is more particularly directed to tensioning devices of the type wherein the yarn passes between a spherical ball-like element and an underlying member supportively seating such element. Illustrative tensioning devices of the foregoing general type are disclosed in U.S. Pat. Nos. 3,753,535, 2,373,513, 2,222,921, 1,785,987, 1,490,512, 1,432,399, 1,408,560 and 1,040,185 and in British Patent No. 299,620.

Yarn tensioning devices are employed in large quantities in a wide variety of textile manufacturing or processing operations. The operating characteristics required of such devices may differ markedly from one use-application or operational environment to another, depending upon such variable factors as the size, texture and speed of the particular yarn to be tensioned, and the magnitude of the tension to be induced in such yarn. For example, the proper tensioning of a yarn containing slubs or kinks therein and being used in, say, a high-speed knitting machine, involves factors and problems not present in the tensioning of a smooth yarn being wound upon a cone or other receiving element. It is therefore highly desirable for a tensioning device to be so adjustable that its operating characteristics can be correlated to the particular demands of any one of the many different operational-environments in which its use might be required. It is also highly desirable for such adjustment to be realizable quickly and easily, without the use of any tools or the like, even by only semi-skilled personnel. Further, the aforesaid capability of the tensioning device for such adjustment should be realized without impairing the device's durability or reliability, and without greatly increasing its cost.

SUMMARY OF THE INVENTION

With the foregoing in mind, the present invention provides an improved yarn tensioning device, of the seated-ball type and of an inexpensive but durable and reliable construction, which may be quickly and easily adjusted so as to vary as desired certain of its operating characteristics; and which therefore possesses an enhanced versatility permitting its successful utilization in a variety of yarn-tensioning applications, including ones wherein the yarn has slubs or kinks therein.

The present tensioning device includes an annular seating member which underlies and supports a ball element having at least its upper portion projecting into and encircled by a ball receiving member disposed in vertically spaced overlying relationship to the seating member. The ball receiving member limits lateral displacement of the ball element relative to the seating member during operation of the device, at which time the yarn undergoing tensioning passes first upwardly through the seating member and then laterally outwardly between it and the ball element and through the space between the seating member and the overlying ball receiving member. Adjustable means interconnects the ball seating and receiving members for vertical adjustive movement toward and away from one another. Such adjustment may be employed to vary the size of the space through which the exiting yarn passes and/or to vary the degree of constraint imposed by the ball receiving member upon the ball's lateral movement. Additionally, the aforesaid adjustment capability facilitates the use in the device of ball elements of widely varying diameters, including ones of quite large diameter.

In a preferred embodiment of the invention hereinafter described, detent means are provided in association with the adjustable interconnecting means, for the purpose of releasably retaining the seating member in any one of a plurality of possible adjustive positions relative to the ball receiving member, and the ball receiving member is so constructed as to accommodate therein, when desired, one or more additional ball elements disposed in superimposed relationship upon the ball element supported by the seating member.

DESCRIPTION OF THE DRAWINGS

Still other features of the invention will be apparent from the following description of an illustrative embodiment thereof, which should be read in conjunction with the accompanying drawings, in which.

DESCRIPTION OF THE PREFERRED EMBODIMENT

Figure 1:
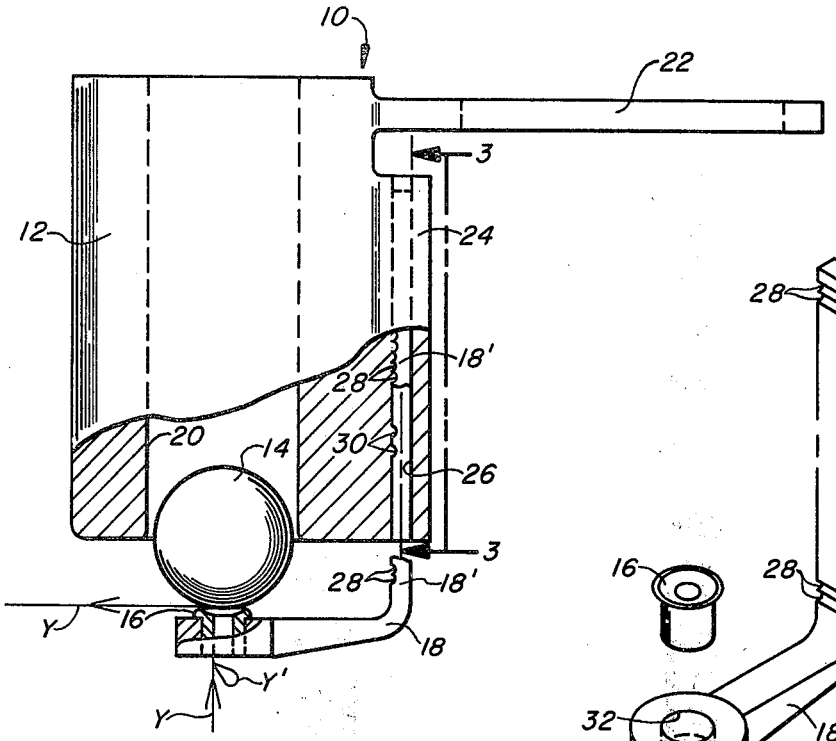
FIG. 1 is a side elevational view of a yarn tensioning device in accordance with the invention, some components of the device being partially broken away to better disclose details of constructions.

Referring more particularly to the drawings, the yarn tensioning device designated in its entirety in FIG. 1 by the numeral 10 generally includes a ball-receiving main body member 12, at least one ball-like element 14, ball seating means in the form of an annular seating member 16, and adjustable means including a generally L-shaped member 18 interconnecting members 12,16 for adjustive movement toward and away from each other. Ball 14 and seating member 16 are preferably respectively formed of exceedingly wear-resistant metallic and ceramic materials. The remaining components of device 10 may be and preferably are formed, as by injection-molding techniques, from wear-resistant plastic material.

Main body member 12 is of elongate and generally tubular shape, having a central bore 20 extending therethrough and opening from its opposite upper and lower ends. A slotted mounting arm 22 is connected to or (as shown) formed integrally with the upper portion of member 12, and projects laterally outwardly therefrom. Arm 22 is adapted to be bolted or otherwise secured to a suitable support (not shown) and to thereby mount device 10 in proximity to a running yarn Y whose tension is to be controlled. When device 10 is so mounted by arm 22, member 12 would normally be disposed in a substantially upright position, with the common central axis of it and of bore 20 extending generally vertically. Subsequent reference herein to "vertical" and/or "horizontal" directions are predicated upon the assumption of device 10 being so mounted.

Figure 4:
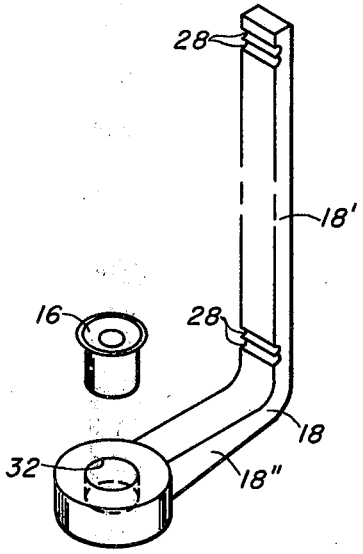
FIG. 4 is an exploded perspective view of the ball seating and interconnecting members of the device.
Figure 2:
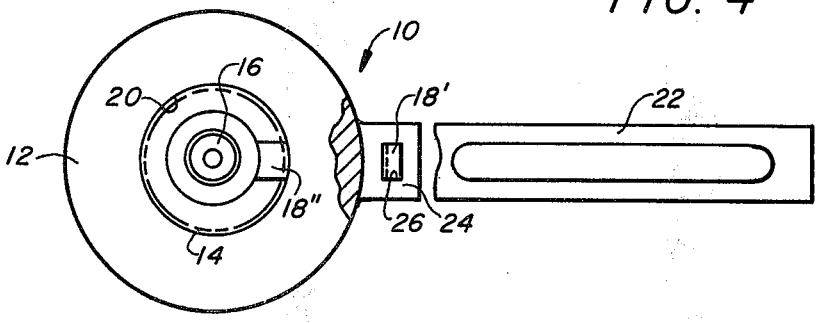
FIG. 2 is a top plan view of the device of FIG. 1, with one component partially broken away and with the ball element shown in phantom lines.
Figure 3:
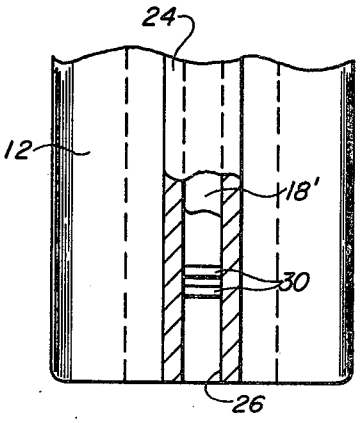
FIG. 3 is a fragmentary view of the device, partially in rear elevation and partially in vertical section, taken approximately along the line 3—3 of FIG. 1.

A pad-like projection 24 is provided upon the exterior surface of member 12 beneath arm 22. A slot 26 of substantially rectangular cross-sectional configuration extends completely through projection 24 in parallel relationship to the axis of bore 20 of member 12. The longer, vertically-extending leg 18' of L-shaped member 18 possesses a generally rectangular cross-sectional configuration complementary to that of slot 26, and is closely received within slot 26 for sliding adjustive movement longitudinally thereof, i.e., in a direction parallel to the substantially vertical axis of bore 20 of member 12. Detent means are provided upon confronting adjacent surfaces of slot 26 and leg 18' of member 18 for releasably retaining leg 18' within any desired one of a plurality of possible vertical adjustive positions within slot 26. Such detent means comprises a plurality of transversly extending grooves 28 (see particularly FIG. 4) provided in closely spaced relationship to one another along substantially the entire length of the inner face of leg 18', and at least one complementary shaped and transversly-extending rib-like projection 30 provided upon the confronting face of slot 26. While two projections 30 are shown in the drawings, a greater or lesser number might be provided. Irrespective of their number, however, at least one of the projections 30 should be located adjacent the lower portion of slot 26, so that the same will be received within one of the grooves 28 upon leg 18' of member 18 even when the latter is in an extreme downwardly-adjusted position. The reception of projections 30 within any of the grooves 28 securely retains leg 18' of member 18 at whatever vertical adjustive position it might then occupy. The resiliency of the plastic material from which leg 18' of member 18 is formed permits, however, sliding movement of leg 18' to another adjustive position within slot 26 when desired.

The shorter, generally horizontally extending leg 18'' of member 18 mounts annular ball seating member 16 beneath tubular member 12, with the central axes of members 12,16 in vertically aligned relationship to each other. The generally tubular-shaped lower portion of ball seating member 16 projects through and is suitably secured, as by means of a press-fit, within a vertical bore 32 (FIG. 4) provided through the free end portion of leg 18'' of member 18. The enlarged upper portion of member 16 projects slightly above the upper surface of leg 18'' of member 18, and supportingly underlies element 14. At least the upper portion of ball element 14 projects into and is received by the lower portion of the bore 20 within tubular member 12. The adjacent cylindrical surface of bore 20 extends in spaced encircling relationship to ball element 14 and limits the amount of its lateral displacement relative to seating member 16.

As is shown in FIG. 1, a running yarn Y to be tensioned by device 10 passes upwardly to and through the tubular lower portion of seating member 16. Yarn Y then passes over and laterally outwardly from the enlarged upper portion of member 16, upon which ball element 14 is seated, at which point the desired tensioning of the yarn occurs. Yarn Y then exits laterally from device 10, in any angular direction other than that which would bring it into engagement with leg 18' of member 18, through the passage defined by the vertical spacing between members 12 and 16.

Among many other possible utilizations, device 10 may be Advantageously employed for the tensioning of yarns containing slubs or kinks, such as the kink Y' shown in the yarn Y of FIG. 1, therein. As running yarn Y passes into device 10 along its previously-described entering path of travel, it will be appreciated that kink Y' may be removed therefrom, prior to its engaging ball element 14, by preceding engagement with the tubular lower portion of member 16 and/or by the slight snubbing action emanating from the substantially right-angular relationship existing between the yarn's entering and exiting paths of travel. Even if kink Y' should not be removed from yarn Y in the aforesaid manner, it will be appreciated that its engagement with ball element 14 would occasion only minimal vertical displacement of ball element 14 from seating member 16, due to the exiting path of travel of yarn Y being laterally, rather than vertically, directed. This of course is desirable since excessive displacement of ball element 14 from seating member 16 would result in a detrimental decrease in the tension of yarn Y. Other detrimental results which might ensue if the exiting path of travel of yarn Y extended upwardly through bore 20 of member 12, rather than laterally as shown, would be the possible entrapment of kink Y' between ball element 14 and the adjacent side of bore 20; and/or — particularly when the yarn Y is of a "fuzzy" type — the accumulation of lint and the like within bore 20. Such results cannot transpire when device 10 is employed in the manner shown in FIG. 1. Any lint removed from yarn Y during its passage through device 10 is automatically discharged therefrom, and does not tend to accumulate within bore 20 or elsewhere within the device. And the laterally-directed exiting path of travel of yarn Y is spaced so distal from member 12 as to preclude any possibility of the latter entrapping kink Y'. This is usually desirable, since entrapment could result in abrupt increase in the yarn's tension, or even breakage of the yarn.

Figure 5:
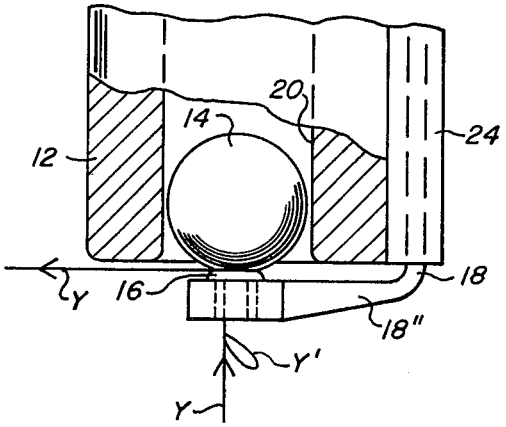
FIG. 5 is a fragmentary side elevational view, partially broken away, showing the lower portion of the device with the seating member in an upwardly adjusted position.

On the other hand, it might in certain applications of device 10 be more important to prevent slubs or kinks in the yarn undergoing tensioning from passing through the device and to a delicate machine component located "downstream" therefrom. In such a situation, seating member 16 could be adjusted upwardly, as shown in FIG. 5 and by appropriate upward displacement of leg 18' of member 18 within slot 26, so as to provide only a relatively narrow passageway beneath member 12 for the exiting path of travel of yarn Y. In such adjusted position of device 10 the kink Y', if not earlier removed from yarn Y during its entering passage upwardly through seating member 16, would likely engage the undersurface of member 12 during its exiting passage from device 10. While such engagement could cause breakage of yarn Y in those instances when kink Y′ is incapable of being removed therefrom, such alternative might be preferable to having the kink pass to and possibly extensively damage a delicate machine component (not shown) located downstream from device 10. Even when seating member 16 occupies an upwardly-adjusted position such as shown in FIG. 5, it will be appreciated that any lint removed from yarn Y will still be discharged from device 10, rather than accumulating therein.

Figure 6:
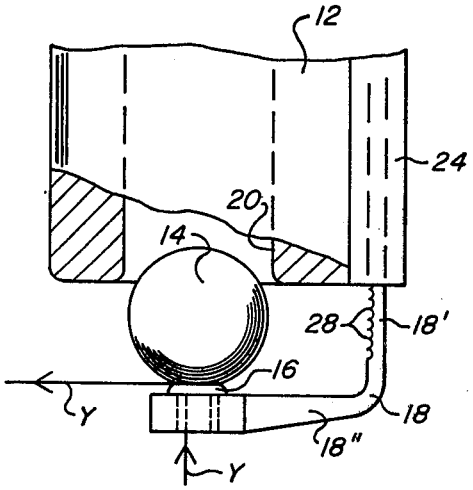
FIG. 6 is a side elevational view, partially broken away, showing the lower portion of the device with the seating member in a downwardly adjusted position.

Upward adjustment of ball seating member 16 from its FIG. 1 and to its FIG. 5 position, or to any intermediate position, varies only the spacing between members 12,16, and does not also vary the degree of lateral constraint imposed upon ball element 14 by member 12. In both the FIG. 1 and the FIG. 5 adjustive positions of the components of device 10, lateral displacement of ball element 14 relative to seating member 16 is constrained by member 12 to the same, maximum extent. However, the adjustable interconnection provided by member 18 and slot 26 between members 12,16 does permit the degree of lateral constraint imposed by member 12 upon ball element 14 to be varied within a significant range when desired. This may be done simply by moving member 16 downwardly, by sliding leg 18′ of member 18 downwardly within slot 26 of member 12, to a lower adjustive position such as shown in FIG. 6. In the FIG. 6 adjustive position of the components of device 10, it will be apparent that the degree of lateral constraint imposed upon ball element 14 by member 12 is significantly less than is imposed upon ball element 14 when the components of device 10 are in their adjustive positions shown in FIG. 1 or FIG. 5. This of course is due to the fact that a lesser part of the upper portion of ball element 14 projects into bore 20 of member 16. Other variations in the degree of lateral constraint imposed upon ball element 14 may be similarly realized by moving members 18,16 downwardly from their FIG. 1 position to an extent greater or less than that shown in FIG. 5.

Figure 7:
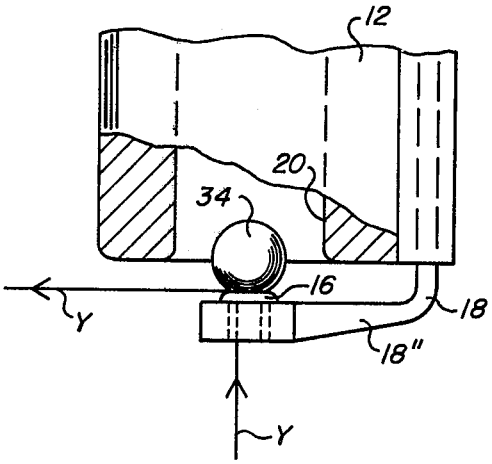
FIG. 7 is a side elevational view, partially broken away, showing the lower portion of the device and the use of a ball element having a diameter smaller than that shown in FIG. 1.
Figure 8:
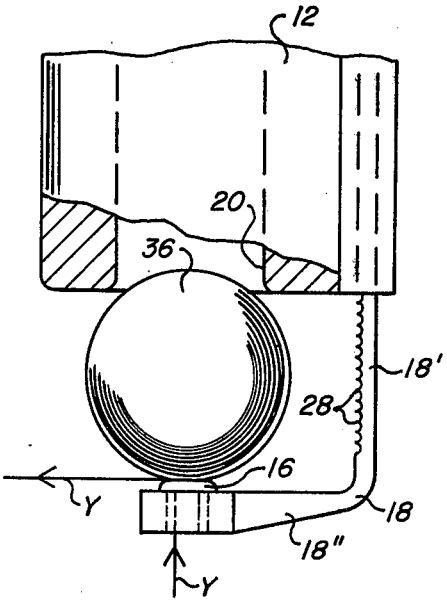
FIG. 8 is a side elevational view, partially broken away, showing the lower portion of the device and the use of a ball element having a diameter larger than that shown in FIG. 1.

The adjustable capability of device 10 also facilitates the use therein, when desired, of ball elements of widely varying diameters, as is indicated in FIGS. 7 and 8. The ball element 34 shown in FIG. 7 is of considerably smaller diameter than the ball element 14 shown in FIGS. 1–6. Ball 34 might be employed, for instance, when it is desired for device 10 to impose only a small tensioning force upon an extremely fine yarn Y. In contrast, the ball element 36 shown in FIG. 8 might be employed when the imposition of a tensioning force of greater magnitude is desired. Ball element 36 has a diameter considerably larger than that of the ball 14 of FIGS. 1–6, and even larger than the diameter of the bore 20 within tubular member 12. Notwithstanding its sizable diameter, ball 36 can still be employed in device 10 by adjusting seating member 16 downwardly until only a desired part of the uppermost portion of the ball element is received with bore 20 of member 12.

Figure 9:
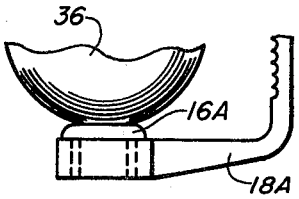
FIG. 9 is a fragmentary side elevational view of the lower portions of a ball element and of a seating and interconnecting member of a different size than that shown in FIGS. 1–8.

Device 10 may also be readily adjusted when desired to vary the size of the ball seating member 16 associated therewith. This is illustrated in FIG. 9, which shows a larger-diameter seating member 16A supporting the ball element 36 of FIG. 8. Seating member 16A of FIG. 9 is carried by an L-shaped member 18A substantially identical to, and interchangable with, the member 18 shown in FIGS. 1,2 and 4–8. By simply moving member 18 downwardly until its leg 18′ is displaced entirely from slot 26 of the projection 24 upon member 12, member 18 may be disassociated from device 10 and the member 18A (FIG. 9) substituted therefor. A plurality of substitute members 18A, each carrying a seating member 16A of a different size, might be provided for use in association with each device 10. The removable nature of members 18,18A also permits convenient replacement of a seating member 16 or 16A which has become damaged or worn in use.

In addition to varying the tensioning force imposed upon a yarn by employing ball elements of varying diameters, it will also be apparent that the tensioning force may be increased by placing one or more additional ball elements (not shown) within tubular member 12 in superimposed relationship to the ball element supported upon seating member 16. Thus, as is apparent from the FIG. 1, the height of tubular member 12 is sufficient to readily receive therein, in superimposed relationship to the ball element 14 there shown, a plurality of additional identical ball elements (not shown).

While a preferred embodiment of the invention has been specifically shown and described, this was for purposes of illustration only, and not for purposes of limitation, the scope of the invention being in accordance with the following claims.

That which is claimed is:

1. A yarn tensioning device of the seated-ball type, comprising:

an elongate ball receiving member having a bore extending completely therethrough and opening from opposite ends thereof;

means connected to said elongate member for mounting the same in a generally upright position with one end thereof lowermost;

an annular ball seating member disposed beneath said one end of said elongate member in vertically spaced and axially-aligned relationship to said bore thereof;

a ball element supported upon said seating member for in conjunction therewith imposing a tensioning force upon a running yarn passing during operation of said device first upwardly through said seating member and then laterally outwardly from between said seating member and said ball element below said one end of said elongate member;

said ball element projecting upwardly from said seating member into said bore of said elongate member and being thereby constrained from excessive lateral displacement relative to said seating member during operation of said device;

said elongate member having a length sufficient to receive therein, when desired, a plurality of additional ball elements in superimposed relationship to said ball element supported by said seating member;

and adjustable interconnecting means interconnecting said seating member and said elongate member for adjustment of the vertical spacing between said members.

2. A device as in claim 1, wherein said ball element has a diameter less than the diameter of said bore.

3. A device as in claim 1, wherein said ball element has a diameter greater than that of said bore.

4. A device as in claim 1, and further including resilient detent means operatively associated with said adjustable interconnecting means for releasably retaining said ball seating and ball receiving members in desired positions of vertical adjustment relative to one another.

5. A yarn tensioning device of the seated-ball type, comprising:

an elongate ball receiving member having a bore extending therethrough and opening from at least one end thereof;

means connected to said elongate member for mounting the same in a generally upright position with said one end thereof lowermost;

an annular ball seating member disposed beneath said one end of said elongate member in vertically spaced and axially-aligned relationship to said bore thereof;

a ball element supported upon said seating member for in conjunction therewith imposing a tensioning force upon a running yarn passing during operation of said device first upwardly through said seating member and then laterally outwardly from between said seating member and said ball element below said one end of said elongate member;

said ball element projecting upwardly from said seating member into said bore of said elongate member and being thereby constrained from excessive lateral displacement relative to said seating member during operation of said device;

and adjustable interconnecting means interconnecting said seating member and said elongate member for adjustment of the vertical spacing between said members;

said interconnecting means including a generally L-shaped interconnecting member having a generally horizontally extending leg portion and a generally vertically extending leg portion, said ball seating member being carried by said generally horizontally extending leg portion of said L-shaped member, and said elongate member having a slot therein extending in laterally spaced and substantially parallel relationship to the axis of said bore, said generally vertically extending leg portion of said L-shaped member being received within said slot and being slidably adjustable longitudinally thereof for varying the vertical spacing between said ball seating member and said elongate member.

6. A device as in claim 5, and further including detent means for releasably securing said interconnecting member and said elongate member in desired positions of vertical adjustment relative to each other.

7. A device as in claim 6, wherein said detent means comprises a plurality of transversly extending and longitudinally spaced grooves provided upon said generally vertically extending leg portion of said L-shaped interconnecting member, and at least one projecting element disposed within said slot of said elongate member for mating reception within different ones of said grooves upon sliding adjustment within said slot of said leg portion of said generally L-shaped interconnecting member.

8. A device as in claim 7 wherein said interconnecting member is removable, when desired, from said slot.

* * * * *